US006295852B1

(12) United States Patent
Kipping et al.

(10) Patent No.: US 6,295,852 B1
(45) Date of Patent: Oct. 2, 2001

(54) DESCALING METHOD FOR A METAL STRIP AND A DESCALING ARRANGEMENT THEREFOR

(75) Inventors: Matthias Kipping, Herdorf; Peter Sudau, Hilchenbach, both of (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/585,142

(22) Filed: Jun. 1, 2000

(30) Foreign Application Priority Data

Jun. 7, 1999 (DE) ..... 199 25 809

(51) Int. Cl.[7] ..... B21B 45/04

(52) U.S. Cl. ..... 72/39; 72/202; 72/227; 72/250

(58) Field of Search ..... 72/39, 201, 202, 72/227, 250, 40

(56) References Cited

U.S. PATENT DOCUMENTS 3,811,305 * 5/1974 Saylor, Jr. ..... 72/39
4,403,492 * 9/1983 Hope ..... 72/201
5,758,530 * 6/1998 Yoshikawa et al. ..... 72/40

FOREIGN PATENT DOCUMENTS 195 35 789 A1 3/1997 (DE) .

* cited by examiner

*Primary Examiner*—Ed Tolan
(74) *Attorney, Agent, or Firm*—Friedrich Kueffner

(57) ABSTRACT

In a method and a device for descaling a metal strip, the metal strip is guided in a transport direction from a first roll stand to a second roll stand. A descaling device is positioned between the first and second roll stands. A descaling liquid is sprayed onto the metal strip from a working distance relative to the metal strip via the descaling device. The metal strip is moved at the location of the descaling device by a forced deflection amount in a direction transverse to the transport direction via an advancing element. A position of the descaling device is adjusted based on the forced deflection amount such that the working distance stays the same.

16 Claims, 2 Drawing Sheets

1
2
3
4
5, 6
5, 7
6'
7'
8
9
10
11
II
x
α
a*
b*

DESCALING METHOD FOR A METAL STRIP AND A DESCALING ARRANGEMENT THEREFOR

BACKGROUND OF THE INVENTION

1. Field of the Invention

The invention relates to a method for descaling a metal strip, wherein the metal strip is guided in a transport direction from a forward roll stand to a rearward roll stand, wherein a descaling liquid is sprayed from a working distance onto the metal strip by means of a descaling device between the roll stands, wherein the metal strip, at the level of the descaling device, is deflected by a forced deflection amount in a direction transverse to the transport direction by means of an advancing element. The invention further relates to a corresponding descaling arrangement.

2. Description of the Related Art

When hot-rolling a metal strip, in particular, a steel strip, a scale layer is formed on the metal strip after rolling. This scale layer must be removed in order to be able to produce a metal strip of high-quality. In the prior art, a descaling liquid, in general, water, is sprayed from a working distance under high-pressure onto the metal strip by means of a descaling device.

Metal strips are conventionally rolled in multi-stand roll lines. Between the individual roll stands the metal band is subjected to tension which is to be maintained as constant as possible. Between the two roll stands a looper is conventionally arranged for the purpose of maintaining a constant tension. When advancing the looper against the metal strip, the metal strip is deflected in a direction transverse to the transport direction. In order to prevent the metal strip from contacting the descaling device when being deflected, the descaling device in the prior art is therefore arranged at a relatively large working distance from the metal strip. Moreover, upon deflection of the metal strip the working distance changes. This results in a reduced and non-uniform impact on the metal strip.

From German patent document 195 35 789 C2 a descaling method is known in which the actual distance of the descaling device from the metal strip is detected and the position of the descaling device is controlled such that the actual spacing is substantially maintained at a constant level.

In another German patent application 198 17 002.5, which was not yet published at the time of filing of the priority application of the instant application, a descaling method for a metal strip is disclosed in which the strip profile is determined and the descaling device is adjusted according to the detected course of the profile.

SUMMARY OF THE INVENTION

It is an object of the present invention to provide a descaling method and a corresponding descaling arrangement with which a simple adjustment of the descaling device with respect to the deflections of the metal strip is possible so that a better impact can be achieved.

In accordance with the present invention, this is achieved in that the descaling device can be adjusted according to the forced deflection amount so that the working distance is maintained substantially at a constant level.

In accordance with this method, in the descaling arrangement according to the invention, the descaling device is coupled control-technologically with the advancing element such that the descaling device can be adjusted according to the forced deflection amount.

Preferably, the descaling liquid is sprayed onto the metal strip from a top working distance by means of a top descaling unit and from a bottom working distance by means of a bottom descaling unit. Both descaling units are adjusted simultaneously according to the forced deflection amount.

The descaling liquid is sprayed onto the metal strip by means of the descaling device at a spray angle relative to the metal strip. The efficiency of the descaling action is inter alia also dependent on the spray angle. Preferably, the descaling device is adjusted such that the spray angle remains substantially constant.

DESCRIPTION OF THE PREFERRED EMBODIMENTS

Figure 1:
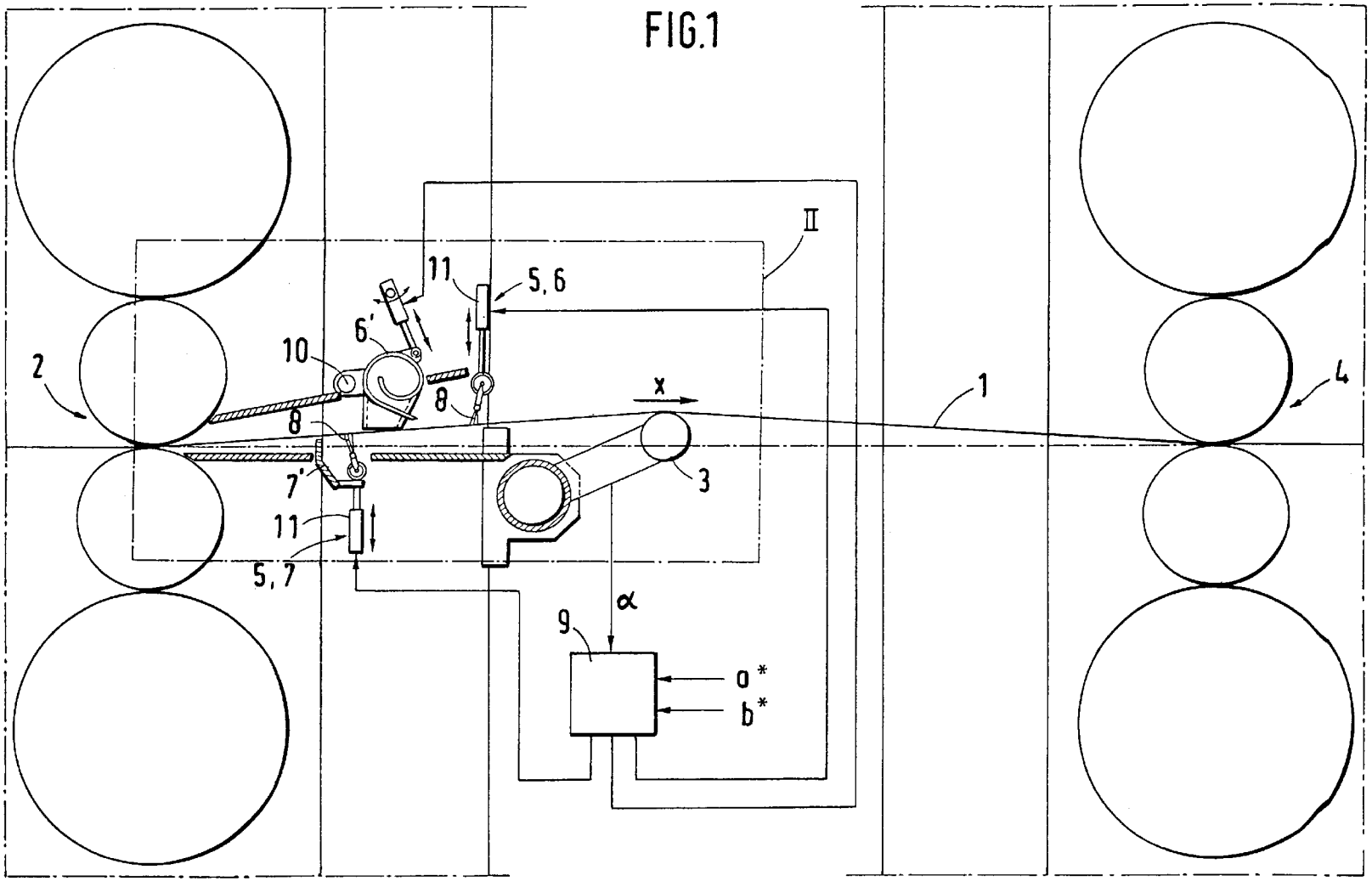
FIG. 1 shows schematically the descaling arrangement according to the invention.

FIG. 1 shows a portion of a multi-stand hot rolling line for a metal strip 1, here in the form of a steel strip. The steel strip 1 according to FIG. 1 is, guided in a transport direction x from a forward roll stand 2 via an advancing element 3 to a rearward roll stand 4. The descaling device 5 is arranged between the forward roll stand 2 and the advancing element 3. The descaling device 5 comprises a top descaling unit 6 and a bottom descaling unit 7. The descaling units 6, 7 spray from an upper working distance a and a lower working distance b, respectively, the descaling liquid 8, in this case, water, onto the steel strip 1 at a spray angle X, Y. The spray angle X or Y is measured relative to the steel strip 1.

The advancing element 3 can be adjusted about a pivot angle a and can in this way be pushed against the steel strip 1. It thus operates as a looper. By advancing the advancing element 3, the steel band 1 is deflected at the level of the descaling device 5 by a forced deflection amount in a direction transverse to the transport direction x. An adjustment of the advancing element 3 is carried out, in particular, in order to maintain tension on the metal strip 1 and/or in order to intermediately store a portion of the metal strip 1. Both can be required as a result of mass flow disturbances between the roll stands 2, 4.

The advancing element 3 is coupled by a control device 9 with the descaling device 5 in a control-technical way. The control device 9 can be pre-programed with nominal working distances a*, b* so that the control device 9 can adjust the descaling units 6, 7 and thus also the descaling device 5 according to the forced deflection amount effected by the advancing element 3 such that the working distances a*, b* are substantially maintained. Accordingly, the actual working distances a, b are substantially maintained at a constant level despite the forced deflection effected by the advancing of the advancing element 3.

The change of the actual working distances a, b is always carried out in the same direction. Preferably, the descaling units 6, 7 are thus coupled with one another in a control-technological way such that both are simultaneously adjusted according to the forced deflection.

The spray angle X, Y, at which the descaling liquid 8 is sprayed onto the steel strip 1, has an effect on the efficiency of descaling. In order to ensure a uniform descaling action, the descaling units 6, 7 are thus adjusted according to the forced deflection such that the spray angles X, Y remain substantially constant.

Figure 2:
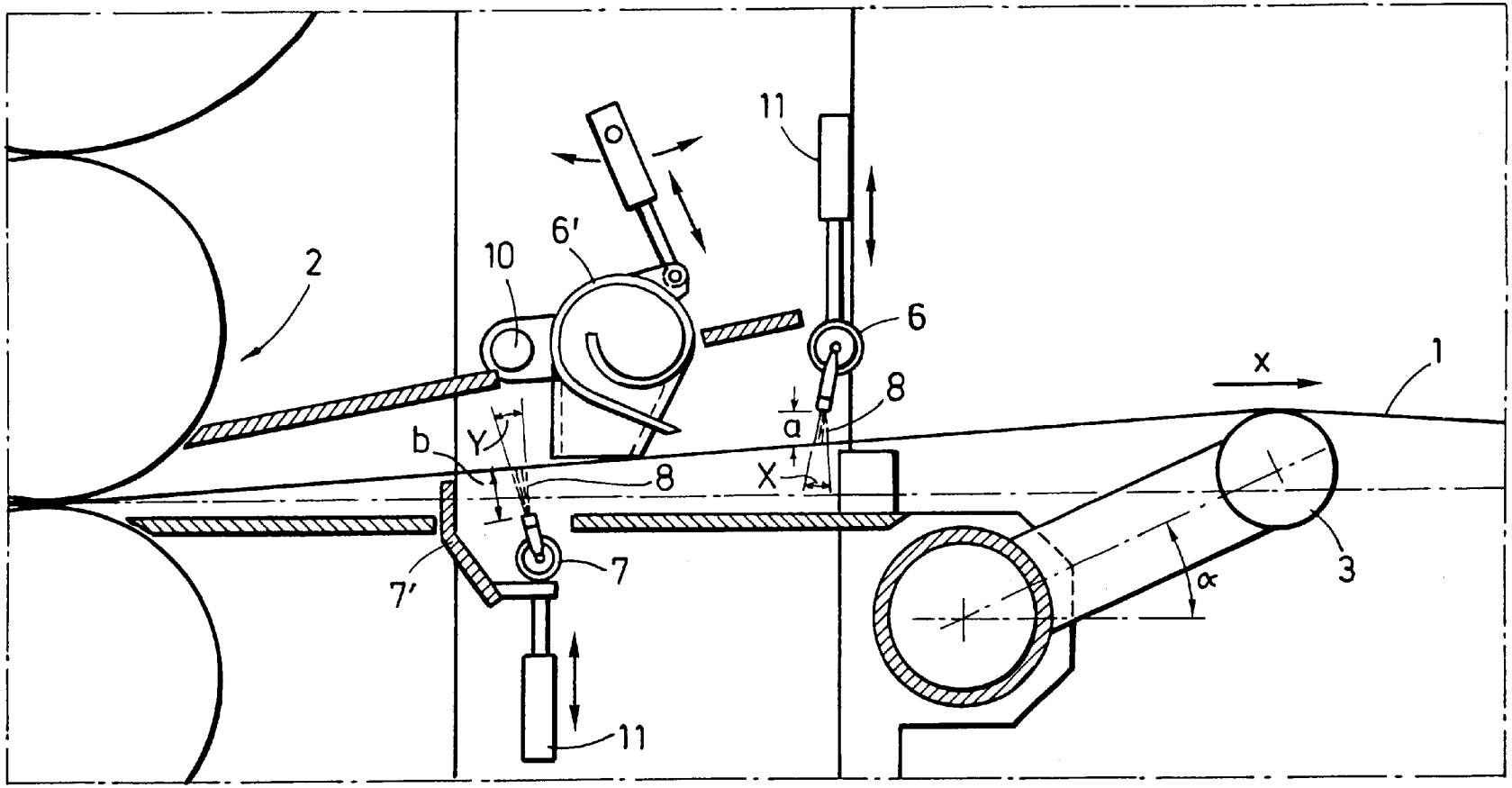
FIG. 2 shows a detail of FIG. 1.

According to FIGS. 1 and 2, the descaling units 6, 7 are adjusted purely in a translatory way. The adjustment of the spray angles X, Y can be realized by a suitable mechanical coupling (for example, a linkage or a gear unit) or by a further advancing element of the descaling units 6, 7. It is also possible to pivotably attach the descaling units 6, 7 on pivot points so that they perform a rotatory movement when adjusted. With a suitable selection of the pivot points, the spray angles X, Y can be automatically corrected in this case.

The adjustment of the actual work in g distances a, b, optionally also of the spray angles X, Y, ensures that the coverage provided by the descaling liquid 8 on the metal strip 1 is always the same. For optimally arranged jets, it is thus possible to avoid stripes on the metal strip 1, which result from non-uniform descaling, and to optimize the descaling efficiency due to the higher impact.

According to FIG. 2 the adjustment of the descaling units 6, 7 is realized by means of hydraulic cylinder devices 11. Instead of the hydraulic cylinder devices 11 it is also possible to employ other adjusting devices, for example, electric or hydraulic motors. A direct mechanical coupling of the advancing element 3 with the descaling units 6, 7 is also possible.

In order to prevent uncontrolled cooling of the forward roll stand 2, the descaling units 6, 7 according to FIGS. 1 and 2 are provided with liquid catching devices 6', 7'. The liquid catching device 7' correlated with the bottom descaling device 7 is rigidly connected to the bottom descaling unit 7. The top liquid catching device 6' correlated with the top descaling device 6 is, however, supported on a pivot point 10. It is adjusted together with the top descaling unit 6 according to the forced deflection amount effected by the advancing element 3.

By means of the adjustment of the descaling device 5 according to the invention when the steel strip 1 is deflected, the descaling units 6, 7 are maintained during the entire descaling process at a constant actual working distance a, b relative to the steel strip 1, this working distance being as short as possible. Accordingly, an almost optimal and especially almost constant so-called impact results. The adjustment of the spray angles X, Y further optimizes the descaling process.

While specific embodiments of the invention have been shown and described in detail to illustrate the inventive principles, it will be understood that the invention may be embodied otherwise without departing from such principles.

What is claimed is:

1. A method for descaling a metal strip, the method comprising the steps of:

guiding a metal strip in a transport direction from a first roll stand to a second roll stand;

providing a descaling device between the first and second roll stands;

spraying from a working distance to the metal strip a descaling liquid onto the metal strip via the descaling device;

moving the metal strip at the location of the descaling device by a forced deflection amount in a direction transverse to the transport direction via an advancing element; and adjusting a position of the descaling device based on the forced deflection amount such that the working distance stays the same.

2. The method according to claim 1, wherein the advancing element is advanced against the metal strip at a location between the first and second roll stands.

3. The method according to claim 2, wherein, in the step of moving, the advancing element is moved about a pivot angle in order to move the metal strip.

4. The method according to claim 1, wherein the descaling device comprises a top descaling unit and a bottom descaling unit arranged opposite one another relative to the metal strip, wherein, in the step of spraying, the descaling liquid is sprayed from the working distance by the top descaling unit onto a top side of the metal strip and by the bottom descaling unit onto a bottom side of the metal strip, wherein the top and bottom descaling units are simultaneously adjusted based on the forced deflection amount such that the working distance stays the same for the top and bottom descaling units.

5. The method according to claim 4, wherein, in the step of spraying, the descaling liquid is sprayed by the top descaling unit at a first spray angle onto the top side and by the bottom descaling unit at a second spray angle onto the bottom side, wherein the top and bottom descaling units are adjusted such that the first and second spray angles stay constant.

6. The method according to claim 4, wherein the first and second descaling units are adjusted by a hydraulic cylinder device.

7. The method according to claim 1, wherein, in the step of spraying, the descaling liquid is sprayed at a spray angle onto the metal strip and wherein the first descaling device is adjusted such that the spray angle stays constant.

8. The method according to claim 1, wherein the first descaling device is adjusted by a hydraulic cylinder device.

9. A descaling arrangement for a metal strip, the device comprising:

a first roll stand and a second roll stand configured to transport a metal strip in a transport direction from the first to the second roll stand;

a descaling device positioned between the first and second roll stands and having a working distance from the metal strip, the descaling device configured to spray a descaling liquid onto the metal strip;

an advancing element configured to move the metal strip at the location of the descaling device by a forced deflection amount in a direction transverse to the transport direction;

a coupling connecting the descaling device and the advancing element, the coupling configured to adjust a position of the descaling device based on the forced deflection amount such that the working distance stays the same.

10. The descaling arrangement according to claim 9, wherein the advancing element is positioned between the first and second roll stands.

11. The descaling arrangement according to claim 10, wherein the advancing element is a looper configured to be pivotally adjusted about a pivot angle.

12. The descaling arrangement according to claim 9, wherein the descaling device comprises a top descaling unit and a bottom descaling unit arranged on the metal strip opposite one another, wherein the top and bottom descaling units are configured to spray the descaling liquid from the working distance onto the top and bottom sides, wherein the coupling is configured such that the top and bottom descaling units are simultaneously adjusted based on the forced deflection amount such that the working distance of the top and bottom descaling units stays the same.

13. The descaling arrangement according to claim 12, wherein the top and bottom descaling units are configured to spray the descaling liquid onto the top side at a first spray angle and onto the bottom side at a second spray angle, respectively, wherein the coupling is configured such that the top and bottom descaling units are simultaneously adjusted based on the forced deflection amount such that the first and second spray angles stay the same.

14. The descaling arrangement according to claim 12, further comprising hydraulic cylinders connected to the top and bottom descaling units and configured to adjust the top and bottom descaling units.

15. The descaling arrangement according to claim 9, wherein the descaling device is configured to spray the descaling liquid onto the metal strip at a spray angle, wherein the coupling is configured such that the descaling device is adjusted based on the forced deflection amount such that the spray angle stays the same.

16. The descaling arrangement according to claim 9, further comprising a hydraulic cylinder device connected to the descaling device and configured to adjust the descaling device.

* * * * *